US008507809B2

(12) United States Patent
Nakayama et al.

(10) Patent No.: US 8,507,809 B2
(45) Date of Patent: Aug. 13, 2013

(54) COMPONENT-EQUIPPED-HOLDER MOUNTING STRUCTURE

(75) Inventors: Makoto Nakayama, Kakegawa (JP); Takahiko Mitsui, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 240 days.

(21) Appl. No.: 13/064,369

(22) Filed: Mar. 22, 2011

(65) Prior Publication Data

US 2011/0232960 A1 Sep. 29, 2011

(30) Foreign Application Priority Data

Mar. 26, 2010 (JP) ..... 2010-072775

(51) Int. Cl.
*H05K 7/02* (2006.01)
*H01R 13/68* (2011.01)

(52) U.S. Cl.
USPC ..... 174/541; 439/620.33; 439/620.34

(58) Field of Classification Search
USPC ..... 174/541; 439/620.33, 620.34
See application file for complete search history.

(56) References Cited

U.S. PATENT DOCUMENTS 4,178,061 A * 12/1979 Ahroni ..... 439/620.29
5,145,414 A * 9/1992 Oikawa ..... 439/620.34
5,171,293 A * 12/1992 Umemoto et al. ..... 439/620.33
5,277,626 A 1/1994 Oikawa et al.
5,751,208 A 5/1998 Martinez
6,406,331 B1 * 6/2002 Brown ..... 439/620.33
D462,331 S * 9/2002 Fukumori et al. ..... D13/161
6,585,541 B2 * 7/2003 Higashida et al. ..... 439/620.27
7,479,867 B2 * 1/2009 Kita ..... 337/230
7,753,735 B2 * 7/2010 Kudo et al. ..... 439/620.27
7,887,372 B2 * 2/2011 Lee et al. ..... 439/620.34
7,988,493 B2 * 8/2011 Taniguchi et al. ..... 439/620.33

FOREIGN PATENT DOCUMENTS

JP 05-159693 A 6/1993

OTHER PUBLICATIONS

Office Action dated Apr. 2, 2013, issued for the corresponding Chinese patent application No. 201110121428.8 and English translation thereof.

* cited by examiner

*Primary Examiner* — Hung Ngo
(74) *Attorney, Agent, or Firm* — Edwards Wildman Palmer LLP

(57) ABSTRACT

A component-equipped-holder mounting structure having an electric component; a holder holding the electric component; and a holder mounting portion. The electric component includes a housing and a terminal extending therefrom. The holder includes a holder body, a pair of holder arms extending therefrom and configured to position the housing therebetween, the holder arms holding the electric component displaceably such that the electric component is positioned in a longitudinal direction of a mating terminal to be connected to the electric component, and a locking portion protruding from the pair of holder arms and configured to be brought into locking engagement with the housing. The holder mounting portion includes an accommodating portion accommodating therein a mating terminal with the holder slidably inserted into the holder mounting portion.

5 Claims, 15 Drawing Sheets

COMPONENT-EQUIPPED-HOLDER MOUNTING STRUCTURE

CROSS-REFERENCE TO RELATED APPLICATION

This application is related to co-pending application "HOLDER-MOUNTING STRUCTURE" filed concurrently herewith in the names of Makoto Nakayama and Takahiko Mitsui, which application is assigned to the assignee of the instant application and is incorporated by reference herein.

This application claims priority to Japanese Patent Application No. 2010-072775, filed Mar. 26, 2010, which is incorporated by reference herein.

BACKGROUND OF THE INVENTION

1. Field of the Invention

The present invention relates to a holder-mounting structure configured for mounting of (a) a holder having an electric component to (b) a holder mounting portion provided in an electrical junction box.

2. Description of the Related Art

Automobile and other vehicles incorporate various electronic devices. In order to deliver supply of electricity to these various electronic devices, the automobiles include electrical junction boxes that integrate electric components such as connectors, relays, and fuses, the junction boxes being provided between a power source and the electronic devices. A holder mounting portion is provided in the electrical junction box, and a holder having at least one electric component (which is referred to as "component-equipped holder" throughout this specification) is mounted to the holder mounting portion A known mounting structure of this type is disclosed, for example, in Japanese Patent Application Laid-Open Publication No. H5-159693.

The component-equipped holder comprises an electric component such as a fuse and a holder to which the fuse is attached. The holder is formed in a shape of a cylinder having a bottom. Also, the holder includes a guide hole into which the fuse is slidably inserted. The fuse is attached to the holder in a state where the fuse is fitted in the guide hole.

The holder mounting portion has a cylindrical shape and inserted slidably into the holder. Also, the holder mounting portion is partitioned by a plurality of partition walls so that a plurality of female terminals are accommodated therein. When the holder is slidably inserted into the holder mounting portion, a terminal of the fuse is pressed into the female terminal so that the fuse is connected to the female terminal.

A downside to such a state-of-the-art component-equipped holder is that the female terminal connected to the electric wire may be positioned in a displaced state with respect to its legitimate position defined by design due to distortion and obliquity in the female terminal caused by the electric wire being pulled. Meanwhile, the fuse is fitted into the guide hole so that its displacement with respect to the holder is prevented. Accordingly, the fuse is moved close to the female terminal displaced with respect to the legitimate position. In this case, the female terminal may be forcibly and/or torsionally inserted, which requires a larger force (i.e., an insertion force). Further, when the female terminal is forcibly and/or torsionally inserted, the fuse may experience deformed or damaged.

SUMMARY OF THE INVENTION

In view of the above identified problems, an object of the present invention is to provide a component-equipped-holder mounting structure that reduces the insertion force in insertion of the electric component in the mating terminal by virtue of inserting the electric component is inserted to the mating terminal without forcible or torsional insertion thereof and prevents deformation and damage to the mating terminal.

According to a first aspect of the present invention, there is provided a component-equipped-holder mounting structure comprising: (a) an electric component; (b) a holder configured to hold the electric component; and (c) a holder mounting portion.

The electric component includes a housing and a terminal extending from the housing.

The holder includes (i) a holder body, (ii) a pair of holder arms extending from the holder body and being configured to position the housing of the electric component therebetween, the holder arms being configured to hold the electric component displaceably such that the electric component is positioned in a longitudinal direction of a mating terminal to be connected to the electric component, and (iii) a locking portion protruding from the pair of holder arms and being configured to be brought into locking engagement with the housing of the electric component; and The holder mounting portion includes an accommodating portion configured to accommodate therein a mating terminal with the holder slidably inserted into the holder mounting portion.

Preferably, a dimension of the pair of holder arms from the holder body to the locking portion is defined such that a gap is created between the holder body and the housing.

Preferably, the pair of holder arms are sized and dimensioned to provide a gap between the holder arms and the housing.

Preferably, the pair of locking portions are sized and dimensioned to provide a gap between the locking portions and a part of the electric component residing between the locking portions.

Some objects, features and advantages of the present invention include, but not limited to, effective and reliable prevention of deformation and damage to the mating terminal and reduction in the insertion force for inserting the electric component into the mating terminal. Other objects, features, and advantages of the present invention will be apparent in view of this disclosure to those skilled in the art.

BRIEF DESCRIPTION OF THE DRAWINGS

The above and other objects and advantages of the present invention will be apparent upon reading of the following detailed description, taken in conjunction with the following accompanying drawings, in which like reference numerals represent corresponding parts throughout.

DETAILED DESCRIPTION OF THE EXEMPLARY EMBODIMENT

A component-equipped-holder mounting structure according to one embodiment of the present invention is described hereinafter with reference to FIGS. 1 to 15.

Figure 1:
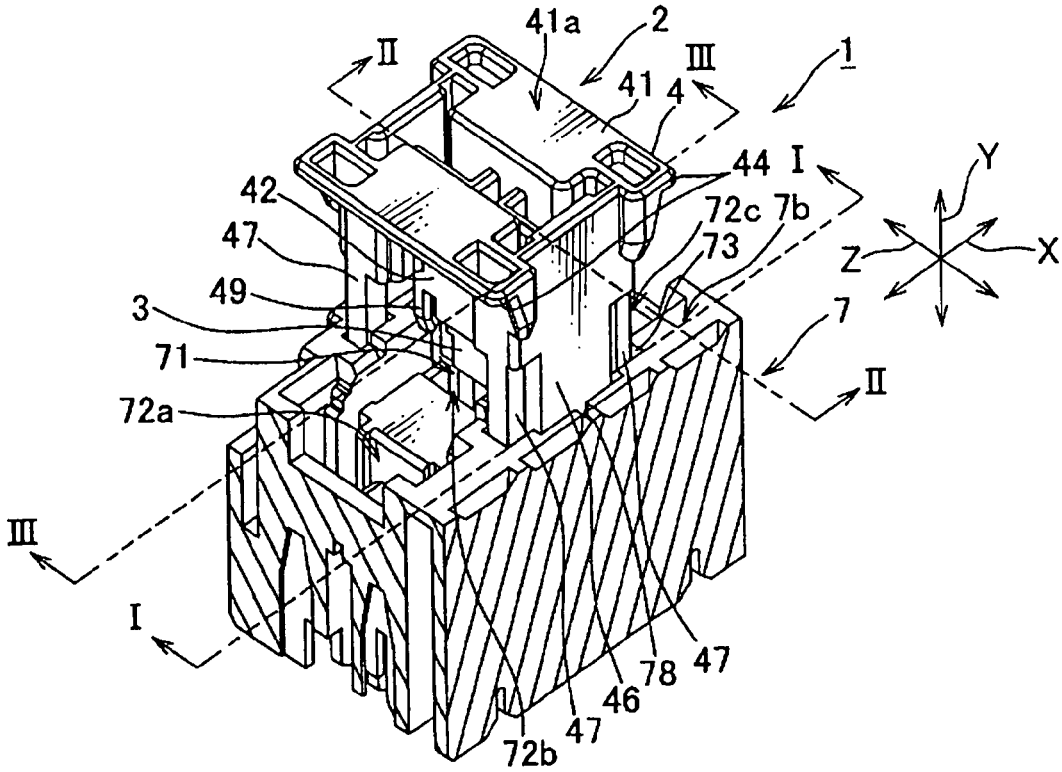
FIG. 1 is a perspective view of the component-equipped-holder mounting structure according to one embodiment of the present invention in a state where a provisional-locking portion is in locking abutment with a provisional-locking engagement portion.

Referring to FIG. 1, there is shown a mounting structure 1 that is configured for mounting of a holder equipped with at least one component (hereinafter referred to as a component-equipped holder 2).

The mounting structure 1 comprises (A) the component-equipped holder 2 and (B) a holder mounting portion 7.

The component-equipped holder 2 includes (a) an electric component, and (b) a holder 4 including a holder body 41 and at least one pair of holder arms 49 protruding from the holder body 41 and configured for positioning of a housing 31 therebetween. In this embodiment, the electric component is a fuse 3.

The holder mounting portion 7 includes an accommodating portion 71 into which the component-equipped holder 2 having a mating terminal accommodated therein is slidably inserted. In this embodiment, the mating terminal is a tuning-fork-type terminal 61 adapted to be connected to the fuse 3.

Figure 3:
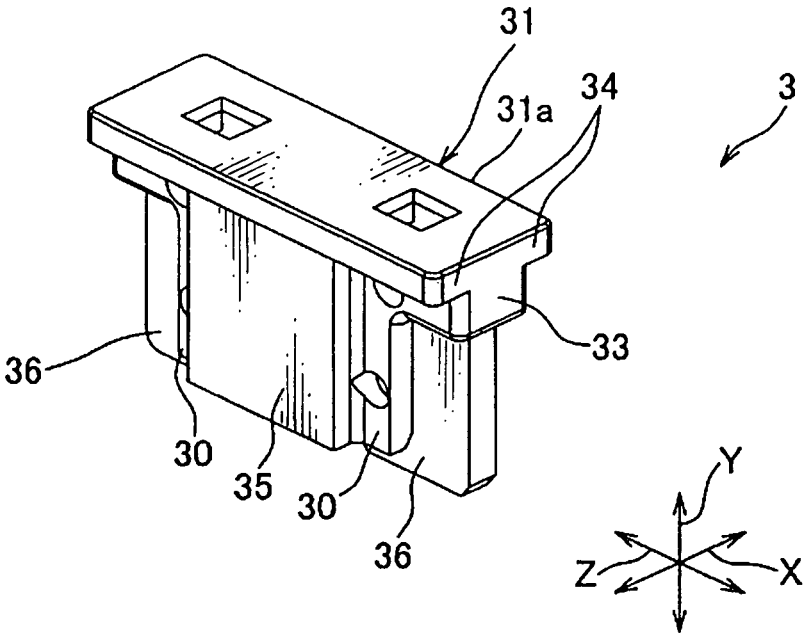
FIG. 3 is a perspective view of the fuse of the component-equipped-holder mounting structure shown in FIG. 1.
Figure 4:
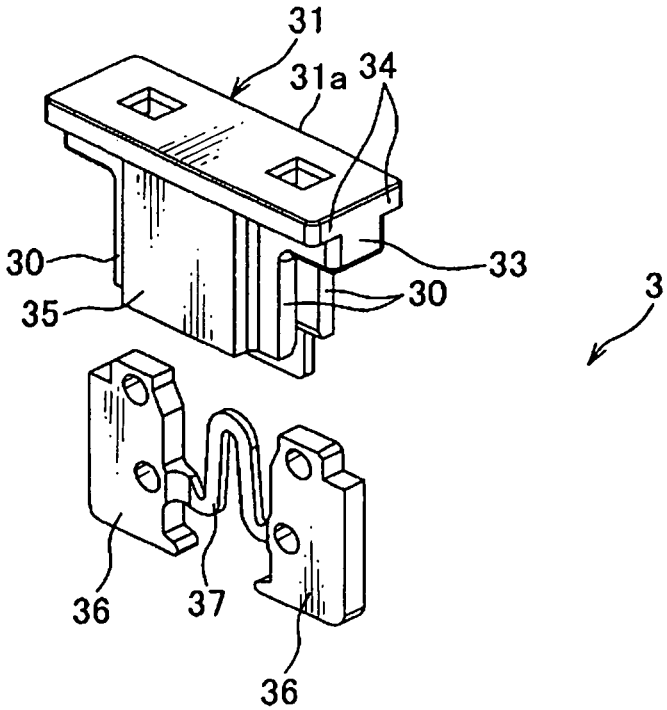
FIG. 4 is an exploded perspective view of the fuse of FIG. 3.

Referring to FIGS. 3 and 4, the fuse 3 includes (i) a housing 31; (ii) a pair of terminals 36 in a shape of a plate protruding from the housing 31; and (c) a fusible member 37*a* provided between the pair of terminals 36 and connected to the pair of terminals 36. It should be noted that an arrow Y in FIG. 3 represents a direction in which the pair of terminals 36 protrudes from the housing 31 (which is hereafter referred to as Y-direction). The fuse 3 may connect a power source to a dark-current component having a clock function that needs to be kept active even when an ignition is turned off. One of the pair of terminals 36 of the fuse 3 is connected to the power source and the other thereof is connected to the dark-current component. When an overcurrent from the power source flows to the dark-current component, the fusible member 37 melts down to block power supply to the dark-current component. The fuse 3 to be connected to the dark-current component is transported in a state where the electrical connection is blocked between the dark-current component and the power source so as to prevent running out of the battery of the automobile in which the fuse 3 is mounted (i.e., a provisionally locked state where the holder 4 is positioned in a provisional-locking position of the holder mounting portion 7). When the automobile is delivered to a user, the fuse 3 connects the power source to the dark-current component to electrically connect the dark-current component to the power source.

The housing 31 includes a rectangular housing body 33 from which the terminals 36 protrude (in the Y-direction); a pair of first locking portions 34; a pair of protective plate portions 35 extending in parallel with a direction in which the pair of terminals 36 are arranged (i.e., a direction indicated by an arrow Z, which is hereafter referred to as Z-direction) and adapted to clamp the fusible member 37 therebetween; and a housing mounting portions 30 each provided at each of ends of the each of the protective plate portions 35 in the Z-direction and adapted to clamp an end of the pair of terminals 36, the end being proximal to the fusible member 37. It should be noted that the arrow Z represents a direction orthogonal to the arrow Y. Also, the Z-direction is the direction in which the pair of terminals 36 are juxtaposedly arranged.

The pair of first locking portions 34 are provided at an end of the housing body 33 away from the terminals 36. The pair of first locking portions 34 are each provided at corresponding each of both edges of the one end of the housing body 33 away from the terminal 36 and extend in the direction indicated by the arrow X, and provided convex in a direction in which the both ends of the housing body 33 becomes away from each other in the direction indicated by the arrow X (hereafter referred to as X-direction. The first locking portion 34 extends over an entire length of the housing body 33 in the Z-direction. It should be noted that the arrow X represents a direction orthogonal to both of the arrow Y and the arrow Z. Also, the X-direction is the direction in which the first locking portions 34 protrude toward the holder arm 49.

The protective plate portions 35 have a shape of a plate. An end of the protective plate portion 35 in the Y-direction continues to the first locking portion 34. The protective plate portions 35 protrude to an extent larger than an extent of protrusion of a later-described housing mounting portion 30 in the X-direction.

The housing mounting portion 30 has a shape of a plate. An end of the housing mounting portion 30 in the Y-direction continues to the housing body 33.

One end of each of the pair of terminals 36 in the Y-direction is embedded in the housing body 33, and an end of each of the pair of terminals 36, the end on the side of the fusible member 37 in the Z-direction, is clamped by the housing mounting portion 30, so that an end of each of the terminals 36, the end being away from the fusible member 37 in the Z-direction is exposed (see FIGS. 3 and 4). Also, the fusible member 37 is covered by the pair of protective plate portions 35.

Figure 5:
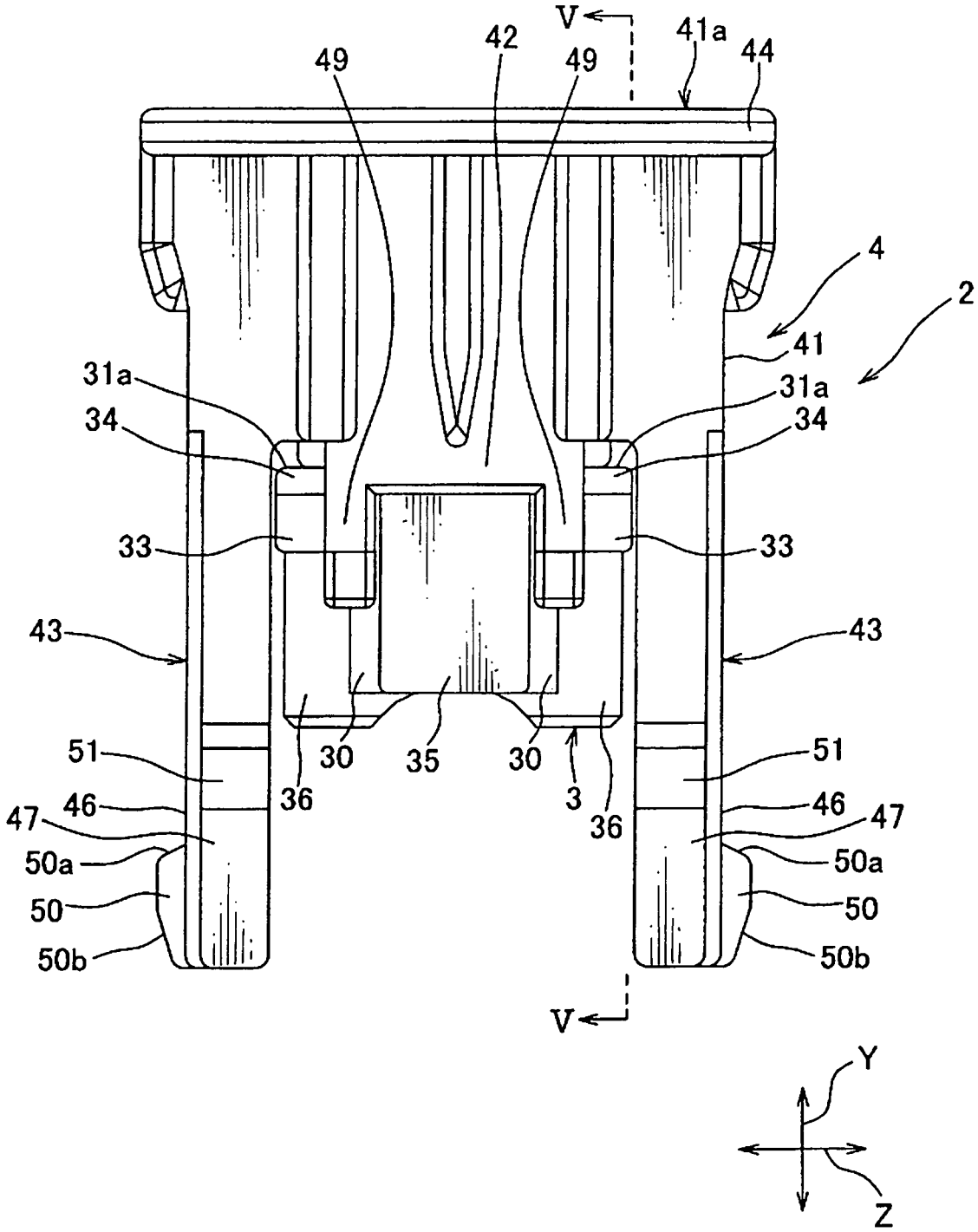
FIG. 5 is a side view of the component-equipped holder of the component-equipped-holder mounting structure shown in FIG. 1.

Referring to FIG. 5, there is shown the holder 4 that is made of insulating synthetic resin. The holder 4 includes a holder body 41, a holding portion 42, and a pair of legs 43 configured for positioning of the pair of holding portions 42 therebetween.

The holder body 41 includes a pair of protruding portions 44. A top surface 41*a* of the holder body 41 is flat.

The pair of protruding portions 44 are each provided at corresponding each of both ends of the holder body 41 in the X-direction and over an entire length of the holder 4 in the Z-direction. Also, the pair of protruding portions 44 each protrude from the both ends of the holder body 41 in the X-direction. The protruding portions 44 and the top surface 41*a* are flush with each other.

The holding portion 42 is provided at a central portion of the holder body 41. The holding portion 42 includes at least one pair of holder arms 49 (two pairs in the illustrated example), and a second locking portion 45 adapted to be brought into locking engagement with the first locking portion 34 of the housing 31. The two pairs of the holder arms 49 are provided on a per-pair basis at corresponding each of the both ends of the holding portion 42 in the Z-direction. Each of the holder arms 49 extends from the holder body 41 in the Y-direction. Also, the pair of holder arms 49 are spaced from each other and configured to be elastically deformable toward and away from each other (in the X-direction). Also, the pair of holder arms 49 are configured for positioning of the fuse 3 such that the terminal 36 extends in a space between the holder arms 49. Specifically, the pair of holder arms 49 are configured for positioning of the housing 31 therebetween. The arrow X indicates a direction in which the pair of holder arms 49 are arranged.

Figure 6:
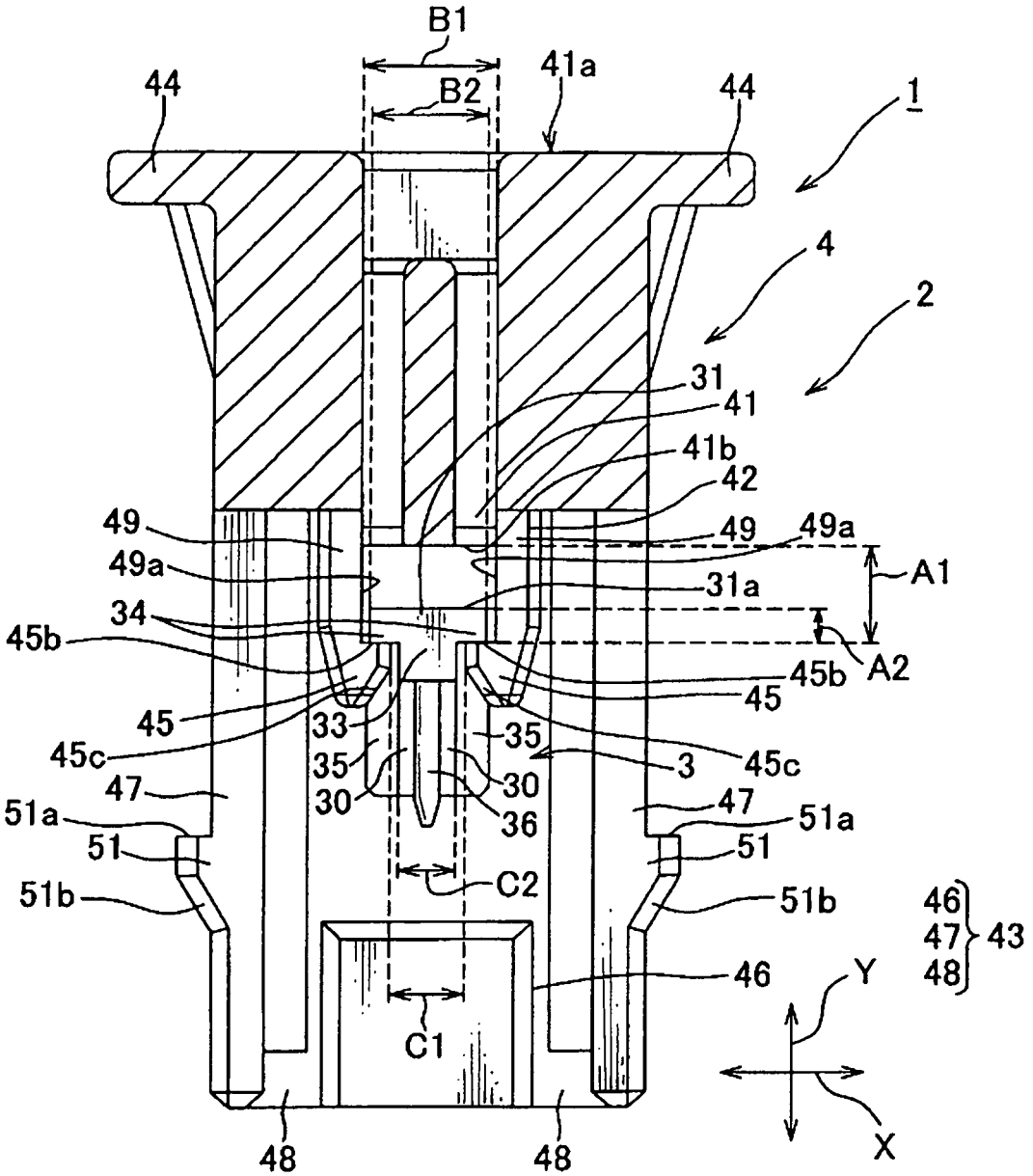
FIG. 6 is a cross-sectional view of the component-equipped-holder mounting structure shown in FIG. 5 taken along the line V-V.

Referring to FIG. 6, the second locking portions 45 protrude from inner surfaces 49*a* facing each other of the pair of holder arms 49 and protrude toward each other. The second locking portion 45 is provided at an end of the holder arm 49, the end being a distal end with respect to the holder body 41. Also, the second locking portion 45 includes a vertical surface 45*b* extending vertically with respect to the inner surface 49*a* of the pair of holder arms 49, and a tapering portion 45*c* slanting from the distal end of the second locking portion 45 with respect to the holder body 41 toward the central portion in the Y-direction and slanting in a direction away from the inner surface 49*a*. It should be noted that the second locking portion 45 corresponds to the "locking portion" in the context of scope of protection.

The pair of legs 43 each extend in a shape of a plate from the holder body 41 in the Y-direction to be spaced from each other, and include a pair of plate portions 46 configured for positioning of the holding portion 42 therebetween; a pair of arm portions 47 provided such that they are aligned with the plate portion 46 in the X-direction and spaced from the plate portion 46; and a pair of connecting portions 48 configured to connect the distal ends of the pair of the arm portions 47 with respect to the holder body 41 to the plate portion 46.

The plate portion 46 includes a complete-locking portion 50 protruding from the outer surface of the plate portion 46 away from the fuse 3.

The complete-locking portion 50 is provided at an end of the plate portion 46 away from the holder body 41. Also, the complete-locking portion 50 includes a first tapering portion 50*a* slanting from an end of the complete-locking portion 50 closer to the holder body 41 toward a central portion in the Y-direction and in a direction away from the outer surface; and the second tapering portion 50*b* slanting from the end of complete-locking portion 50, the end being a distal end with respect to the holder body 41 (i.e., an end of the plate portion 46) toward the central portion in the Y-direction and in a direction away from the outer surface. The slanting of the second tapering portion 50*b* is moderate relative to that of the first tapering portion 50*a*.

The arm portion 47 has a shape of a rod. The arm portion 47 is elastically deformable in the X-direction. An end of the arm portion 47 continues to the holder body 41, and the other end thereof is connected via the connecting portion 48 to an end of the plate portion 46, and the arm portion 47 is adapted to be held at two points.

Also, the arm portion 47 includes a provisional-locking portion 51. The provisional-locking portion 51 protrudes from the outer surface of the arm portion 47, the outer surface being away from the plate portion 46. The provisional-locking portion 51 is provided at the central portion of the arm portion 47 in the Y-direction, and arranged closer to the holder body 41 than the complete-locking portion 50 is.

The provisional-locking portion 51 includes a vertical surface 51*a* provided at an end of the provisional-locking portion 51 closer to the holder body 41 and vertically extending with respect to the outer surface; and a tapering portion 51*b* slanting from an end of the provisional-locking portion 51 away from the holder body 41 toward the central portion in the Y-direction and away from the outer surface.

Still referring to FIG. 6, the component-equipped holder 2 is sized and dimensioned such that a (minimum) dimension A1 in the Y-direction from the horizontal surface 41*b* to the second locking portion 45 is larger than a dimension A2 from the end 31*a* of the housing 31 (away from the terminal 36) to the first locking portion 34. Specifically, the dimension A1 is defined such that a gap is created between the holder body 41 and the housing 31 in the Y-direction. Also, a dimension B1 between the pair of holder arms 49 in the X-direction is larger than a dimension B2 of a portion of the housing 31 residing between the pair of holder arms 49 (i.e., a portion of the housing 31 where the first locking portion 34 is provided). Specifically, the dimension B1 is defined such that there is the gaps between the pair of holder arms 49 and the housing 31 in the X-direction. Also, a dimension C1 between the second locking portion 45 in the X-direction is larger than a dimension C2 of a portion of the fuse 3 residing between the second locking portions 45 (i.e., housing body 33). Specifically, the dimension C1 is defined such that gaps are created between the pair of the second locking portions 45 and a portion of the fuse 3 residing between the second locking portions 45 (i.e., the housing body 33) in the X-direction. Further, as shown in FIG. 5, the dimension between the pair of holder arms 49 in the Z-direction is larger than the dimension of the protective plate portion 35 in the Z-direction, and the dimension between the pair of holder arms 49 in the Z-direction is defined such that a gap is created between itself and the protective plate portion 35. In this manner, the fuse 3 is held such that the fuse 3 is allowed to move with respect to the holder 4 in the directions indicated by the arrows X, Y, and Z (i.e., to be displaceably held).

An electrical junction box is constructed to be mounted in an automobile and distribute electrical power supply from a power source to various electronic devices. The electrical junction box includes a plurality of busbars 6 adapted to connect the fuse 3, a relay, and a connector to each other in accordance with a predetermined pattern; a busbar mounting portion made of insulating synthetic resin in a shape of a plate and adapted to attach a plurality of busbars 6 thereto; and a holder mounting portion 7 adapted to attach the component-equipped holder 2 to the busbar mounting portion.

Figure 7:
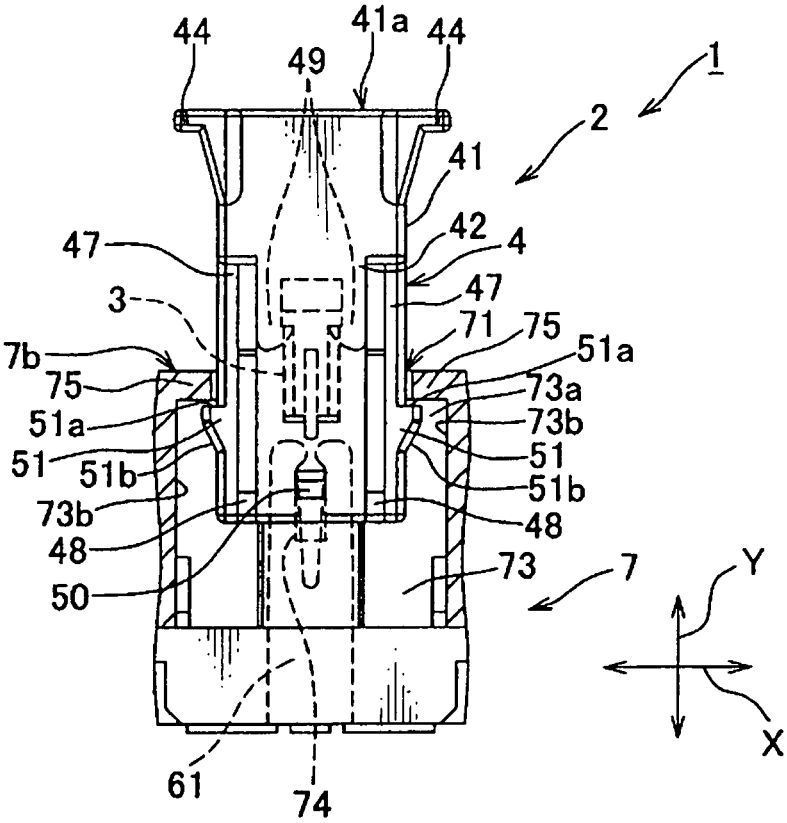
FIG. 7 is a cross-sectional view of the component-equipped-holder mounting structure shown in FIG. 1 taken along the line I-I.

The busbar 6 is made from a conductive metal plate with punching and bending provided as required. Referring to FIG. 7, the busbar 6 includes in one piece therewith: the fuse 3, a relay, a connector and a plurality of tuning-fork-type terminals 61 configured for electrical connection of these members to each other. The tuning-fork-type terminal 61 upstands in the Y-direction. Also, the tuning-fork-type terminal 61 has a shape of a tuning fork in plan view with a slit 61*a* adapted to insert the fuse 3 therein. The slit 61*a* extends straight and forms a notch extending from the central portion of the tuning-fork-type terminal 61 in the Y-direction to an outer edge away from the busbar mounting portion. Also, the fuse 3 is adapted to be inserted into the slit 61*a* to be brought elastically into contact with the tuning-fork-type terminal 61 at an entrance portion of the slit 61*a*, and thereby the fuse 3 is connected, to the busbar 6. It should be noted that the tuning-fork-type terminal 61 corresponds to the "mating terminal" in the context of scope of protection.

The busbar mounting portion includes a plurality of through-holes. The tuning-fork-type terminal 61 is attached to the busbar mounting portion with a tip of the tuning-fork-type terminal 61 passed through the through-hole. In this manner, the tuning-fork-type terminal 61 is attached to the busbar mounting portion such that it upstands from the busbar mounting portion in the Y-direction. Also, the busbar mounting portion includes a relay mounting portion configured for mounting of the relay, and a connector mounting portion configured for mounting of the connector. The relay mounting portion and the connector mounting portion each have a shape of a frame complementary to the outer shapes of the relay and the connector attached to the relay mounting portion and the connector mounting portion. When the relay is attached to the relay mounting portion, the relay is electrically connected to the busbar 6. When the connector is attached to the connector mounting portion, the connector is electrically connected to the busbar 6.

Figure 2:
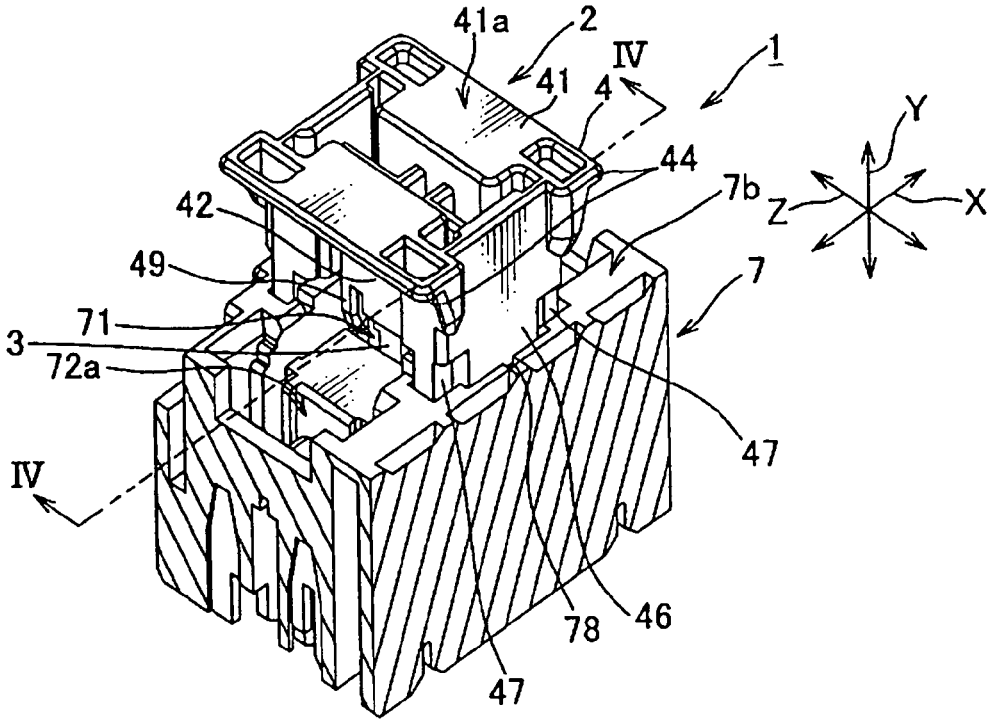
FIG. 2 is a perspective view of the component-equipped-holder mounting structure shown in FIG. 1 in a state where the complete-locking portion is in locking engagement with a complete-locking engagement portion.

Referring again to FIGS. 1 and 2, the holder mounting portion 7 is made of insulating synthetic resin and provided on the electrical junction box. The holder mounting portion 7 is disposed in an overlapping manner upon the busbar mounting portion. The holder mounting portion 7 includes an accommodating portion 71 in which the holder 4 (and accordingly the component-equipped holder 2) is slidably inserted. It should be noted that FIGS. 1 and 2 illustrate part of the electrical junction box.

Figure 8:
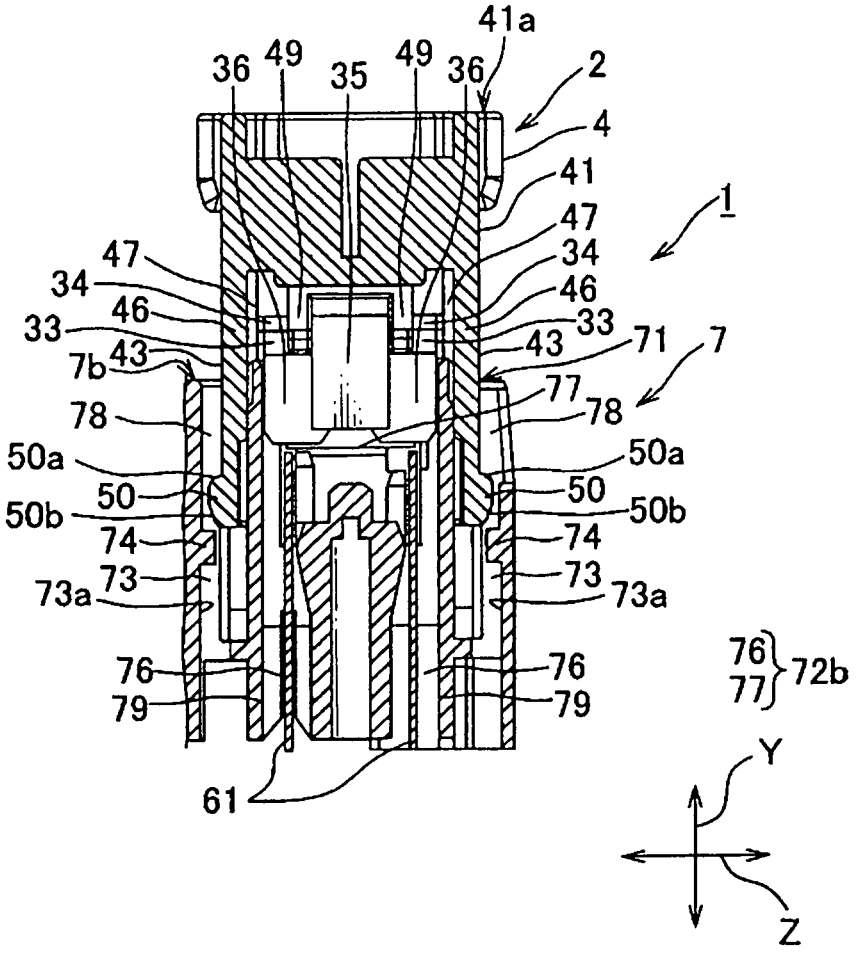
FIG. 8 is a cross-sectional view of the component-equipped-holder mounting structure shown in FIG. 1 taken along the line II-II.

Referring to FIGS. 7 and 8, the accommodating portion 71 includes a fuse cavity 72*b*; a pair of leg-accommodating portions 73 to which the pair of legs 43 are attached, respectively; a complete-locking engagement portion 74 with which the complete-locking portion 50 is brought into locking engagement; and a provisional-locking engagement portion 75 with which the provisional-locking portion 51 is brought into locking engagement.

The fuse cavity 72*b* includes, as shown in FIG. 8, a fuse accommodating portion 77 adapted to accommodate therein the fuse 3 held by the holder 4; and a pair of terminal accommodating portions 76 each adapted to accommodate corresponding each of the pair of tuning-fork-type terminals 61. The pair of terminal accommodating portions 76 are arranged such that the fuse accommodating portion 77 is disposed therebetween in the Z-direction.

The fuse accommodating portion 77 is provided in a shape of a recess on a mounting surface 7*b* to which the fuse 3 of the electrical junction box is mounted. When the complete-locking portion 50 of the component-equipped holder 2 is brought into locking engagement with the complete-locking engagement portion 74 of the holder mounting portion 7, the fuse 3 is accommodated in the fuse accommodating portion 77, and thus the fuse 3 is electrically connected to the tuning-fork-type terminal 61 passed through the terminal accommodating portion 76.

The terminal accommodating portion 76 extends straight in the Y-direction and through the holder mounting portion 7.

The pair of leg-accommodating portions 73 are arranged such that the fuse cavity 72*b* resides therebetween in the Z-direction, and the leg-accommodating portions 73 and the fuse cavity 72*b* (its terminal accommodating portion 76) are separated from each other by the partition wall 79. Also, the leg-accommodating portion 73 includes a groove 78 provided in a shape of a recess on the inner surface 73*a* on which the outer surface of the plate portion 46 is disposed in an overlapping manner. The complete-locking portion 50 is passed through the groove 78.

The complete-locking engagement portion 74 protrudes from a bottom surface of the groove 78 provided in the shape of a recess.

Still referring to FIG. 7, the provisional-locking engagement portions 75 are provided on a pair of inner surfaces 73*b*, the inner surfaces 73*b* being opposed to the outer surface of the arm portion 47 of the leg-accommodating portion 73. The pair of provisional-locking engagement portions 75 are provided at an end of the leg-accommodating portion 73 adjacent to the opening thereof, and protrude from each of the inner surfaces 73*b* in the direction toward each other in the X-direction. Also, by virtue of the provisional-locking engagement portion 75, the opening of the leg-accommodating portion 73 is restricted when compared with the innermost portion thereof. Also, the dimension between the pair of provisional-locking engagement portion 75 in the X-direction is slightly larger than the dimension between the outer surfaces of the pair of the arm portions 47.

Further, there are provided a plurality of fuse cavities 72*a*, 72*c* around the holder mounting portion 7. The fuse cavities 72*a*, 72*c* and the fuse cavity 72*b* (and accordingly, accommodating portion 71) are arranged in the X-direction. Also, the fuse cavities 72*a*, 72*c* include a fuse accommodating portion 77 adapted to accommodate therein a fuse (to which the holder 4 is not mounted), and a pair of terminal accommodating portions 76 configured to accommodate therein the pair of tuning-fork-type terminals 61.

The following describes the construction and arrangement of the component-equipped-holder mounting structure 1 of the holder. First, the housing 31 of the fuse 3 is moved close to a space between the pair of holder arms 49 in the Y-direction. Further, when the fuse 3 is moved toward the innermost portion in the Y-direction, the end 31*a* of the housing 31 is brought into abutment on the tapering portion 45*c* of the second locking portion 45, When further moved, the pair of holder arms 49 is elastically deformed along the tapering portion 45*c* in the direction away from each other, and the first locking portion 34 goes on the second locking portion 45. When further moved, the first locking portion 34 goes beyond the second locking portion 45, and the pair of holder arms 49 are restored to the state before the elastic deformation. In this manner, the fuse 3 is held such that it is allowed to be moved with respect to the holder 4 in the directions indicated by the arrows X, Y, and Z (i.e., held displaceably), so that the component-equipped holder 2 is assembled.

Next, the pair of legs 43 are each inserted into the leg-accommodating portion 73, and the holder 4 is slidably inserted into the accommodating portion 71 such that the fuse 3 is moved close to the fuse accommodating portion 77 of the fuse cavity 72*b*. Thus, the tapering portion 51*b* of the provisional-locking portion 51 is brought into abutment on the provisional-locking engagement portion 75. When the holder 4 is further slid toward an innermost portion in the Y-direction, the pair of the arm portion 47 is elastically deformed along the tapering portion 51*b* in the direction toward each other, and the provisional-locking portion 51 goes on the provisional-locking engagement portion 75. When the holder 4 is further slid, the provisional-locking portion 51 goes beyond the provisional-locking engagement portion 75, and after the pair of the arm portions 47 have been restored to the state before the elastic deformation, the tapering portion 50*b* of the complete-locking portion 50 is brought into abutment on the complete-locking engagement portion 74. At this point, the provisional-locking portion 51 is positioned closer to the innermost portion than the provisional-locking engagement portion 75 in the Y-direction. In this manner, the holder 4 is positioned at the provisional-locking position of the holder mounting portion 7.

In the provisionally locked state where the holder 4 is positioned at the provisional-locking position of the holder mounting portion 7, the fuse 3 held by the holder 4 and the tuning-fork-type terminal 61 of the busbar 6 are not electrically connected to each other (electrically disconnected).

Figure 9:
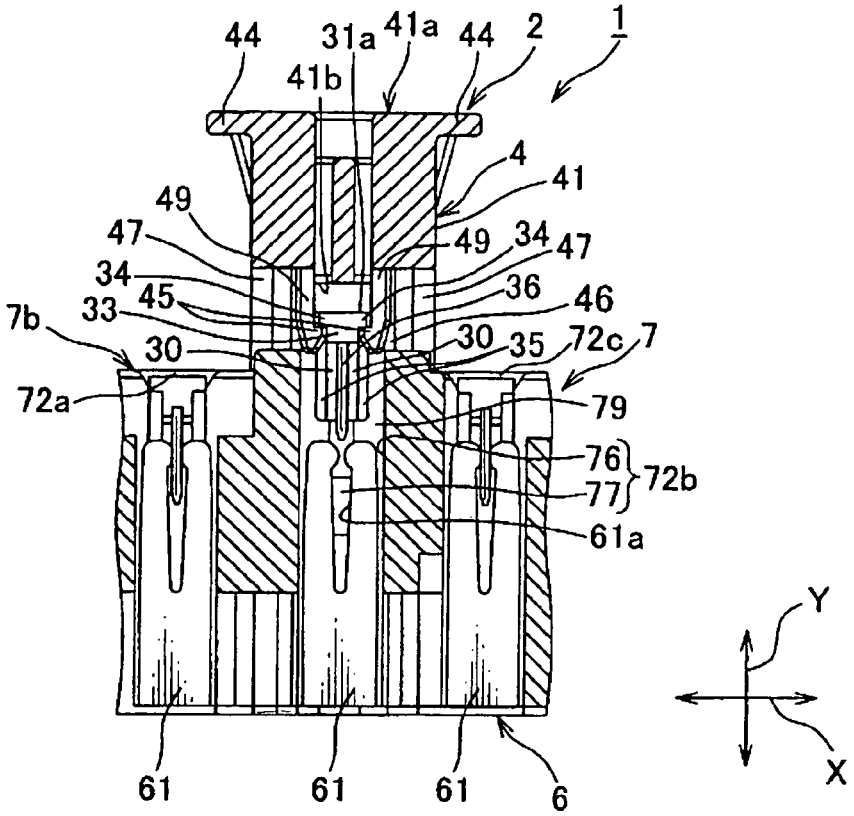
FIG. 9 is a cross-sectional view of the component-equipped-holder mounting structure shown in FIG. 1 taken along the line III-III.
Figure 10:
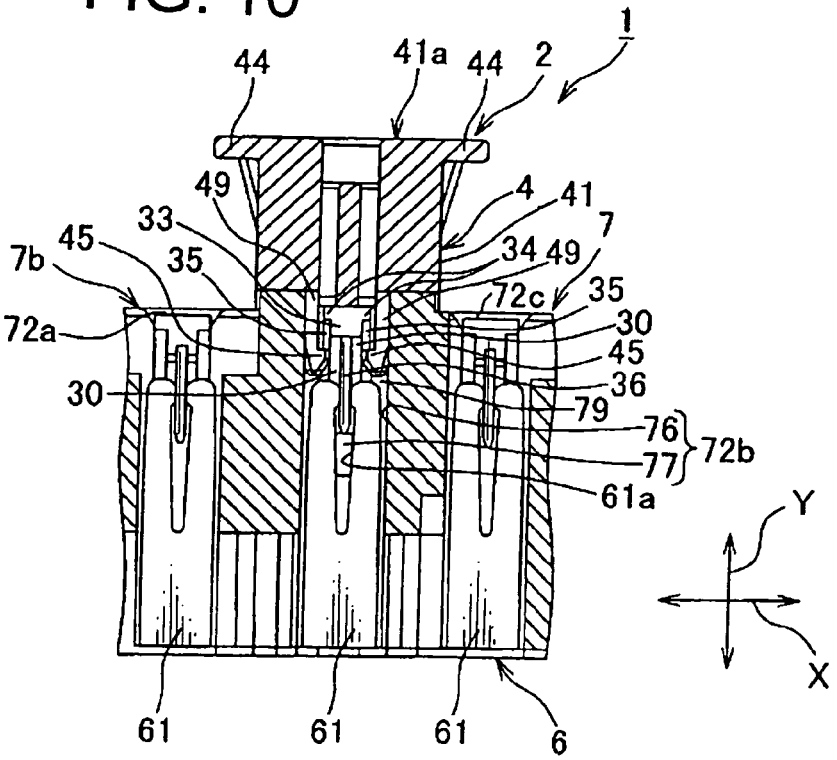
FIG. 10 is a cross-sectional view of the component-equipped-holder mounting structure shown in FIG. 2 taken along the line IV-IV.
Figure 11:
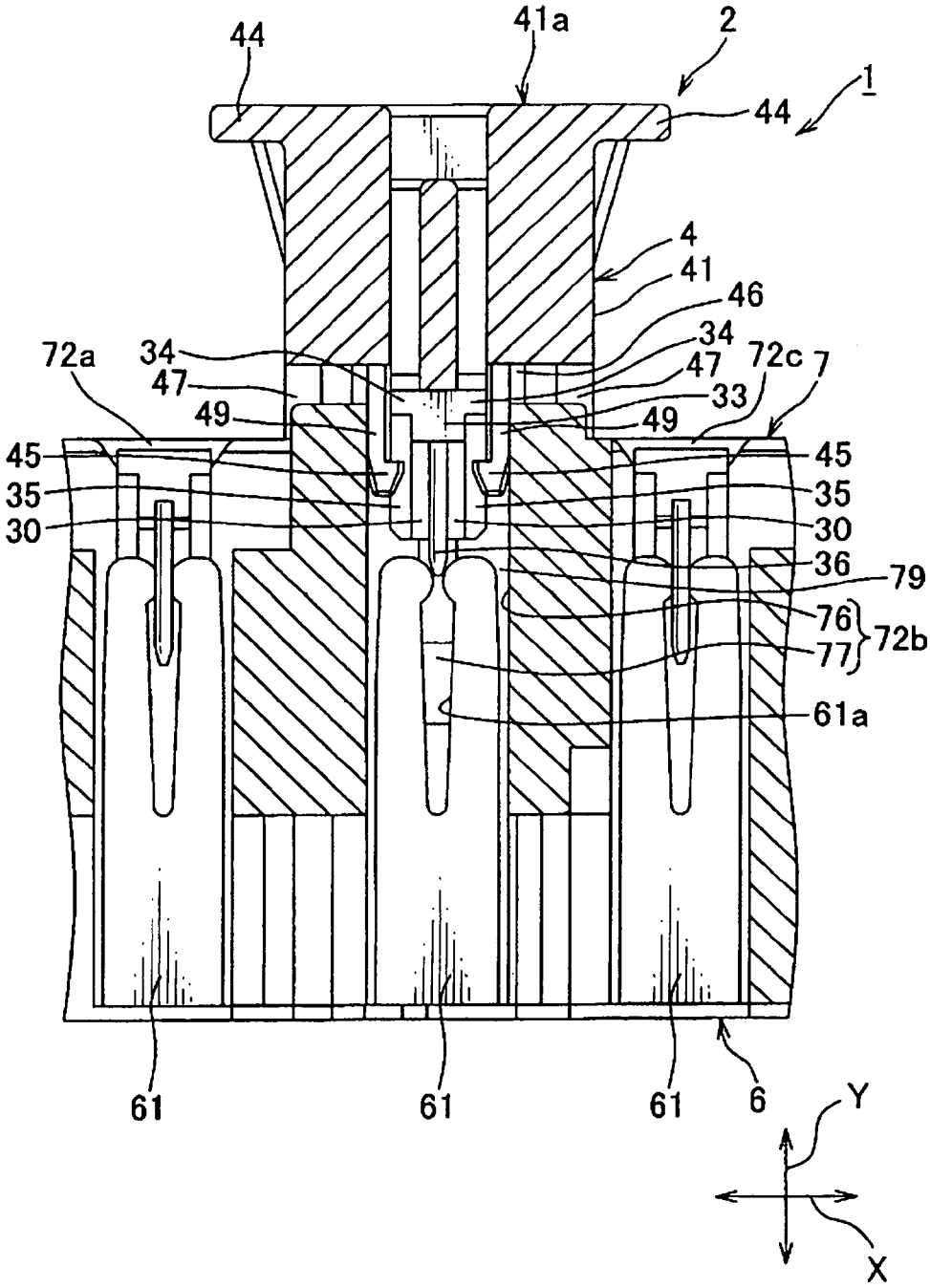
FIG. 11 is an enlarged cross-sectional view of the component-equipped-holder mounting structure whose fuse is connected to the tuning-fork-type terminal.

Next, the following describes a mechanism of connection and disconnection of the fuse 3 held by the holder 4. At this point, as shown in FIGS. 9 to 11, the tuning-fork-type terminal 61 is positioned at a legitimate position defined in accordance with predetermined system design within the terminal accommodating portion 76.

Also, when the fuse 3 held by the holder 4 and the tuning-fork-type terminal 61 of the busbar 6 are to be electrically connected, the following operation is to be performed. As shown in FIG. 9, when the top surface 41*a* of the holder body 41 is pressed in a direction toward the holder mounting portion 7 (the direction indicated by the arrow Y), in the provisionally locked state where the fuse 3 held by the holder 4 and the tuning-fork-type terminal 61 of the busbar 6 are not electrically connected to each other (electrically disconnected). Further, the holder 4 is moved in a direction toward the holder mounting portion 7, the pair of plate portions 46 are elastically deformed in a direction toward each other and along the second tapering portion 50*b* of the complete-locking portion 50, and the complete-locking portion 50 goes on the complete-locking engagement portion 74. When the holder 4 is moved further, as shown in FIG. 11, the tip of the terminal 36, the tip being away from the housing 31 is brought into abutment on an entrance portion of the slit 61*a*. After that, the fuse 3 is raised within the holder 4, and the horizontal surface 41*a* of the holder body 41 and the end 31*a* of the housing 31 are brought into abutment on each other. When further moved, in the state where the horizontal surface 41*a* of the holder body 41 is in abutment on the end 31*a* of the housing 31, a tip of the terminal 36 is pressed along the inner edge of the tuning-fork-type terminal 61 into the slit 61*a*, and at the same time, the complete-locking portion 50 goes over the complete-locking engagement portion 74. In this manner, when the complete-locking portion 50 goes over the complete-locking engagement portion 74, the pair of plate portions 46 is restored to the original state before the elastic deformation, and the complete-locking portion 50 is brought into locking engagement with the complete-locking engagement portion 74. Thus, as shown in FIG. 10, the holder 4 is placed in the complete-locking position of the holder mounting portion 7, and the tuning-fork-type terminal 61 and the fuse 3 are electrically connected to each other.

Also, the following operation is performed when the fuse 3 held by the holder 4 and the tuning-fork-type terminal 61 of the busbar 6 are electrically disconnected from each other.

The protruding portion 44 is raised in a direction away from the holder mounting portion 7 (i.e., in the Y-direction) by holding the protruding portion 44 of the holder body 41 with a finger tip in the complete-locking state where the fuse 3 held by the holder 4 and the tuning-fork-type terminal 61 of the busbar 6 are electrically connected to each other. The pair of plate portions 8 are elastically deformed in a direction toward each other along the first tapering portion 50*a* in the complete-locking portion 50, so that the complete-locking portion 12 goes on the complete-locking engagement portion 17. At this point, the tuning-fork-type terminal 61 and the fuse 3 are connected to each other, and only the holder 4 is raised. When further raised, the fuse 3 is raised in a state where the first and second locking portions 34, 45 are in locking engagement with each other, so that the electrical connection between the tuning-fork-type terminal 61 and the fuse 3 is exited, and at the same time, the complete-locking portion 12 goes beyond the complete-locking engagement portion 17. In this manner, when the complete-locking portion 12 goes beyond the complete-locking engagement portion 17, then the pair of plate portions 8 are restored in a state before the elastic deformation, so that the complete-locking portion 12 and the complete-locking engagement portion 17 are taken out of locking engagement with each other, and thus the holder 4 is taken out of the complete-locking position and placed in the provisional-locking position of the holder mounting portion 7. Also, as shown in FIG. 7, since the provisional-locking portion 51 includes the vertical surface 51*a*, even when the holder 4 is further raised in a direction away from the accommodating portion 71, the holder 7 is prevented from being moved with respect to the holder mounting portion 7 by virtue of the abutment of the vertical surface 51*a* on the provisional-locking engagement portion 75.

According to the above embodiment, the component-equipped-holder mounting structure 1 comprises the electric component (i.e., the fuse 3 in this embodiment) having the housing 31 and the terminals 36 extending from the housing 31; the holder 4 adapted to hold the fuse 3; and the holder mounting portion 7 into which the holder 4 is slidably inserted and having the accommodating portion 71 configured for accommodation of the mating terminal (i.e., the tuning-fork-type terminal 61 in this embodiment) to be connected to the fuse 3. The holder 4 includes the holder body 41; the pair of holder arms 49 extending from the holder body 41 and configured for positioning of the housing 31 therebetween; the locking portion (i.e., the second locking portion 45 in this embodiment) extending from the pair of holder arms 49 and configured for locking engagement with the housing 31. The dimension A1 of the pair of holder arms 49 from the holder body 41 to the second locking portion 45 is defined such that there exists the gap between the holder body 41 and the housing 31. The dimension B1 of the pair of holder arms 49 is defined such that there is the gap between the holder arm 49 and the housing 31. The dimension C1 between the pair of the second locking portions 45 is defined such that there is the gap between the second locking portions 45 and a part of the fuse 3 that resides between the second locking portions 45.

Accordingly, when the fuse 3 is being inserted into the tuning-fork-type terminal 61, the fuse 3 is readily moved (shifted) in the longitudinal direction of the tuning-fork-type terminal 61 without elastic deformation of the pair of holder arms 49 in a direction away from each other (the X-direction), and it is possible to reliably prevent deformation of and damage to the tuning-fork-type terminal 61, and to provide the component-equipped-holder mounting structure 1 with more reduced insertion force, i.e., a force necessary to be exerted when inserting the fuse 3 into the tuning-fork-type terminal 61.

Figure 12:
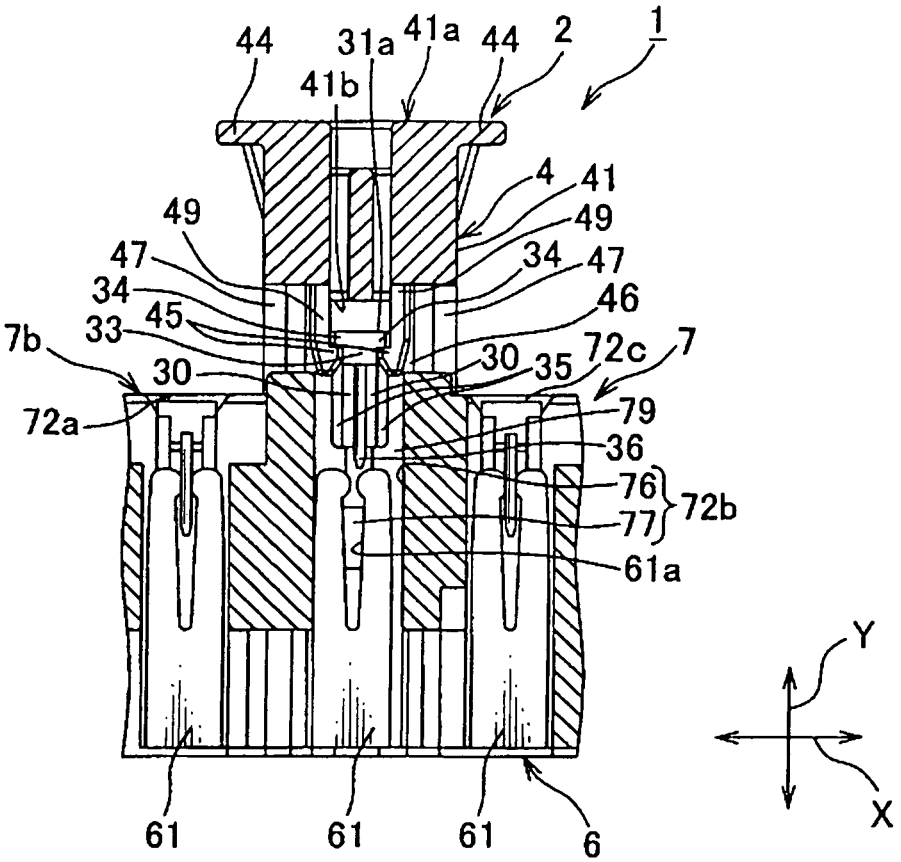
FIG. 12 is a cross-sectional view of the component-equipped-holder mounting structure of the present invention in a state where the tuning-fork-type terminal is arranged in a displaced state with respect to its legitimate position and the fuse is being moved close to the tuning-fork-type terminal.
Figure 13:
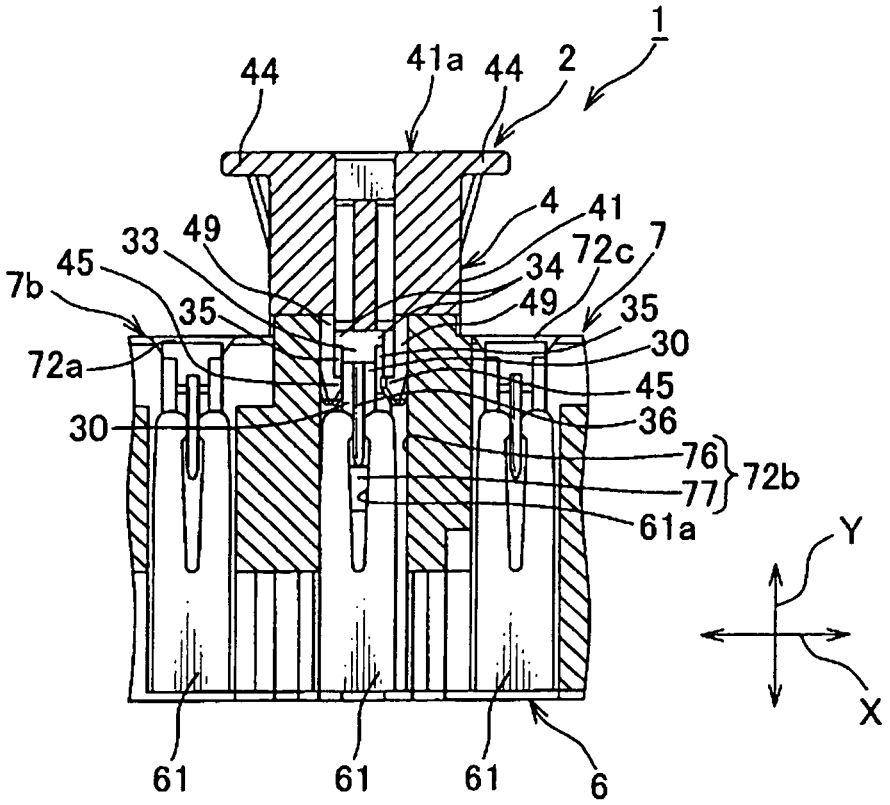
FIG. 13 is a cross-sectional view of the component-equipped-holder mounting structure shown in FIG. 12 in a state where the fuse is connected to the tuning-fork-type terminal.
Figure 14:
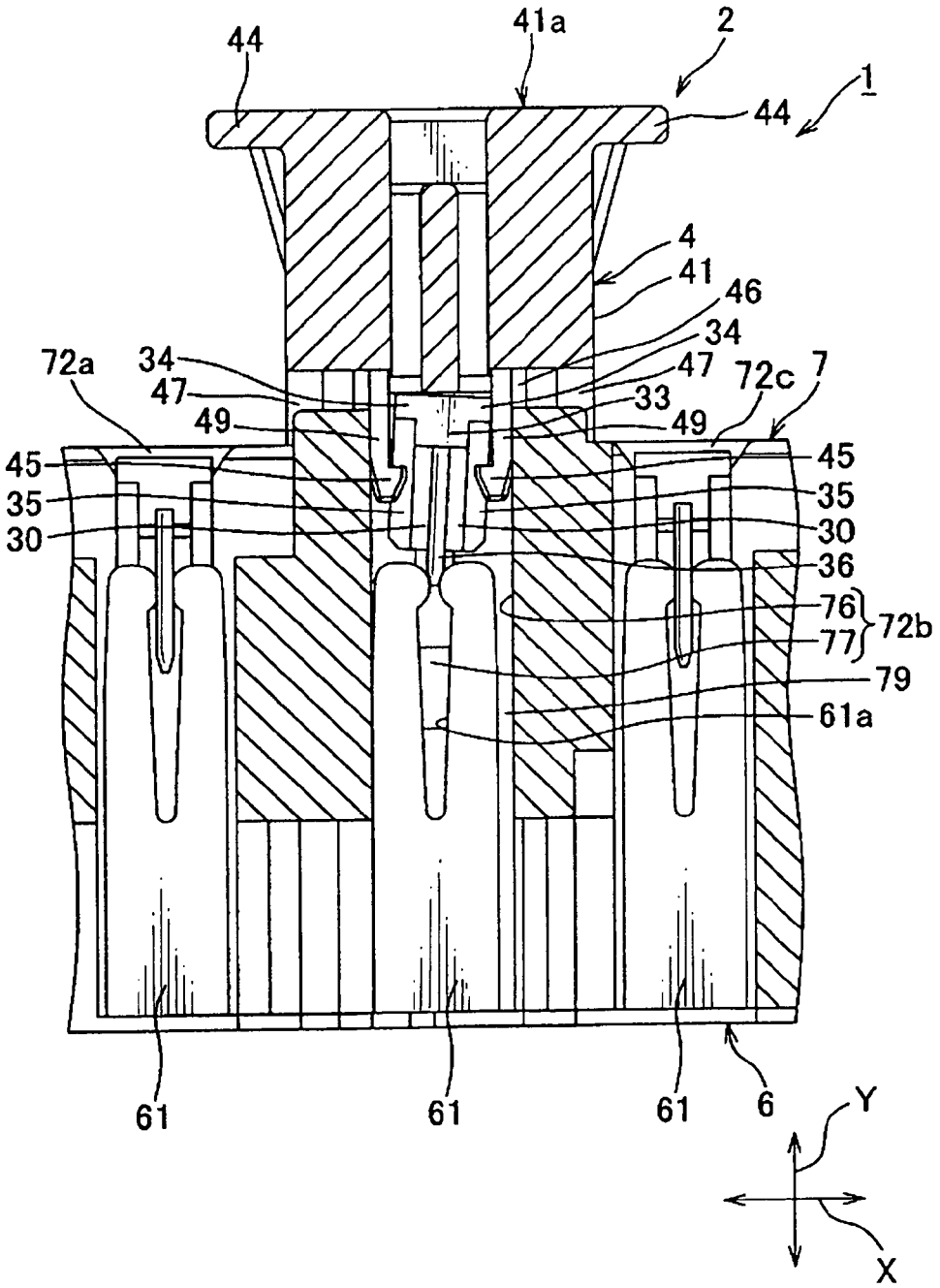
FIG. 14 is an enlarged cross-sectional view of the component-equipped-holder mounting structure shown in FIG. 12 in a state where the fuse is being connected to the tuning-fork-type terminal.

Restated in more detail, for example, the tuning-fork-type terminal 61 may, as shown in FIGS. 12 to 14, positioned with deviation with respect to the legitimate position and in the X-direction. In such a case, when the top surface 41*a* of the holder body 41 is pressed in a direction toward the holder mounting portion 7 (in the Y-direction) in the provisionally locked state where the fuse 3 held by the holder 4 is not electrically connected to the tuning-fork-type terminal 61 of the busbar 6 (i.e., placed in a state of electrical disconnection), then, as shown in FIG. 12, the holder 4 is moved in the direction toward the holder mounting portion 7, a tip of the terminal 36 is brought into abutment on the tuning-fork-type terminal 61, the fuse 3 is raised within the holder 4, and the horizontal surface 41*a* of the holder body 41 is brought into abutment on the end 31*a* of the housing 31. When the holder 4 is further moved, as shown in FIG. 14, in a state where the horizontal surface 41*a* of the holder body 41 is in abutment on the end 31*a* of the housing 31, the tip of the terminal 36 is moved along the outer edge of the tuning-fork-type terminal 61, and thereby the fuse 3 is moved (or shifted) in the X-direction to be slanted with respect to the Y-direction, and brought into abutment on the entrance portion of the slit 61*a*. When the holder 4 is still further moved, then, as shown in FIG. 13, the fuse 3 is moved (or shifted) along the inner edge of the slit 61*a* in the X-direction, and further moved in a state where it is in the longitudinal direction (the Y-direction) of the tuning-fork-type terminal 61, and pressed into the slit 61*a*. In this manner, the tuning-fork-type terminal 61 and the fuse 3 are electrically connected to each other. As has been described in the foregoing, when the fuse 3 is being inserted into the tuning-fork-type terminal 61, the fuse 3 is readily moved (shifted) in the longitudinal direction of the tuning-fork-type terminal 61 without elastic deformation of the pair of holder arms 49 in a direction away from each other (the X-direction), and accordingly, it is possible to reliably prevent deformation of and damage to the tuning-fork-type terminal 61, and provide the component-equipped-holder mounting structure 1 with more reduced insertion force, i.e., the force necessary to be exerted when inserting the fuse 3 into the tuning-fork-type terminal 61.

Figure 15:
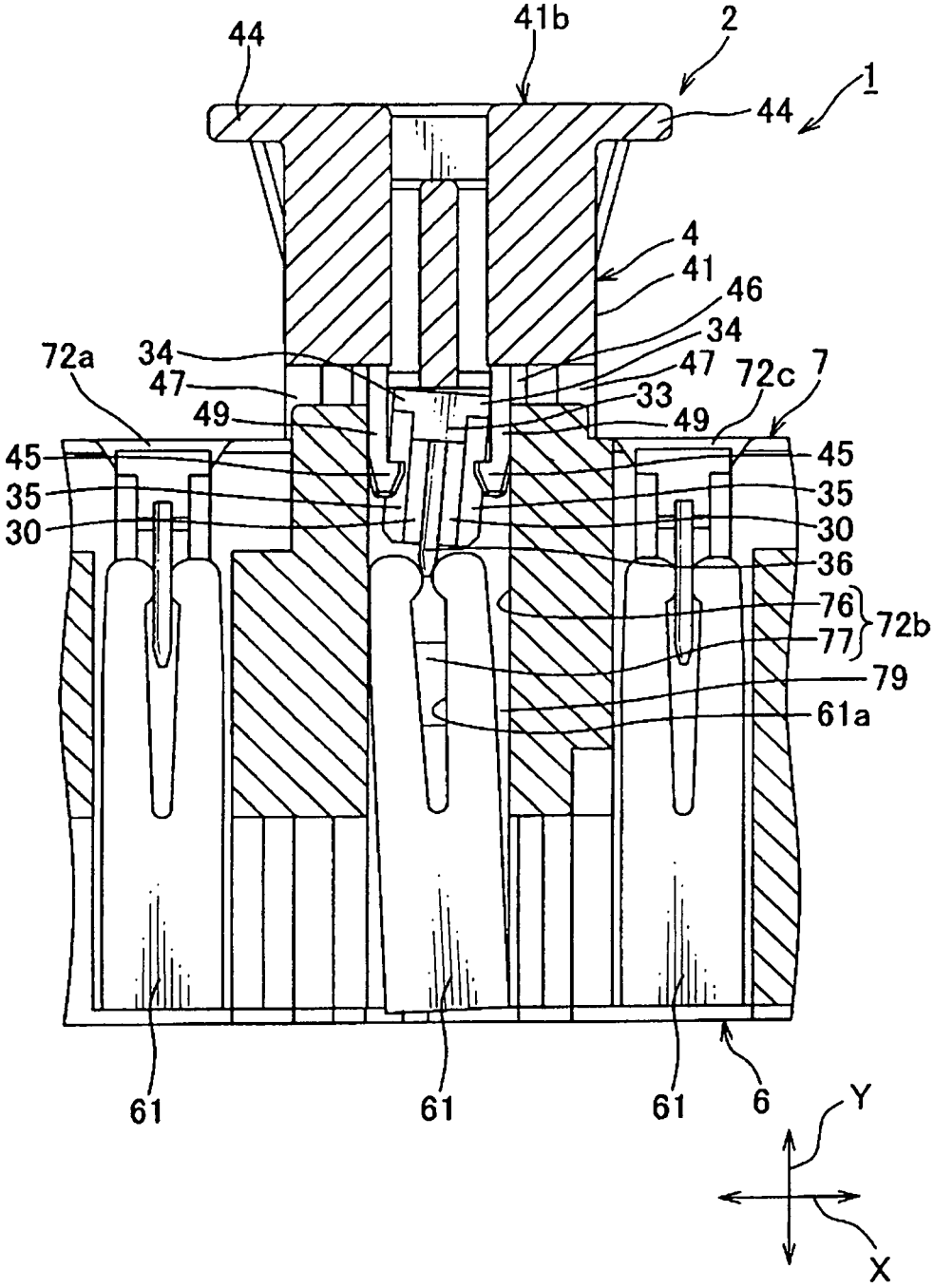
FIG. 15 is an enlarged cross-sectional view of the component-equipped-holder mounting structure of the present invention in a state where the tuning-fork-type terminal is provided in an oblique manner and the fuse is being connected to the tuning-fork-type terminal.

Also, for example, the tuning-fork-type terminal 61 may be, as shown in FIG. 15, arranged in a slanted state with respect to the Y-direction. In such a state, in the provisionally locked state where the fuse 3 held by the holder 4 and the tuning-fork-type terminal 61 of the busbar 6 are not electrically connected to each other (electrically disconnected), when the top surface 41*a* of the holder body 41 is pressed in a direction toward the holder mounting portion 7 (the direction indicated by the arrow Y), the holder 4 is moved in a direction toward the holder mounting portion 7, the tip of the terminal 36 is brought into abutment on the tuning-fork-type terminal 61, the fuse 3 is raised within the holder 4, the horizontal surface 41*a* of the holder body 41 and the end 31*a* of the housing 31 are brought into abutment with each other. When the holder 4 is further moved, in a state where the horizontal surface 41*a* of the holder body 41 is in abutment on the end 31*a* of the housing 31, the tip of the terminal 36 is moved (or shifted) along the outer edge of the tuning-fork-type terminal 61, and thereby the fuse 3 is moved in the X-direction, and moved in a slanted manner with respect to the Y-direction, and is brought into abutment on the entrance portion of the slit 61*a*. When the holder 4 is further moved, the fuse 3 is moved along an inner edge of the slit 61*a* in the X-direction, and further moved (or shifted) in the longitudinal direction of the tuning-fork-type terminal 61, and pressed into the slit 61*a*. In this manner, the tuning-fork-type terminal 61 and the fuse 3 are electrically connected to each other. As has been described in the foregoing, when the fuse 3 is being inserted into the tuning-fork-type terminal 61, the fuse 3 is readily moved (or shifted) in the longitudinal direction of the tuning-fork-type terminal 61 without elastic deformation of the pair of holder arms 49 in a direction away from each other (in the X-direction), and accordingly, it is possible to reliably prevent deformation of and damage to the tuning-fork-type terminal 61, and to provide the component-equipped-holder mounting structure 1 with more reduced insertion force, i.e., the force necessary to be exerted when inserting the fuse 3 into the tuning-fork-type terminal 61.

Also, since the top surface 41*a* of the holder body 41 is flat, the holder 4 can be readily pressed against the holder mounting portion 7. Also, since the holder body 41 includes the protruding portion 44, the holder can be readily raised from the holder mounting portion 7 by raising the protruding portion 44 with the protruding portion 44 held by the finger.

Figure 16:
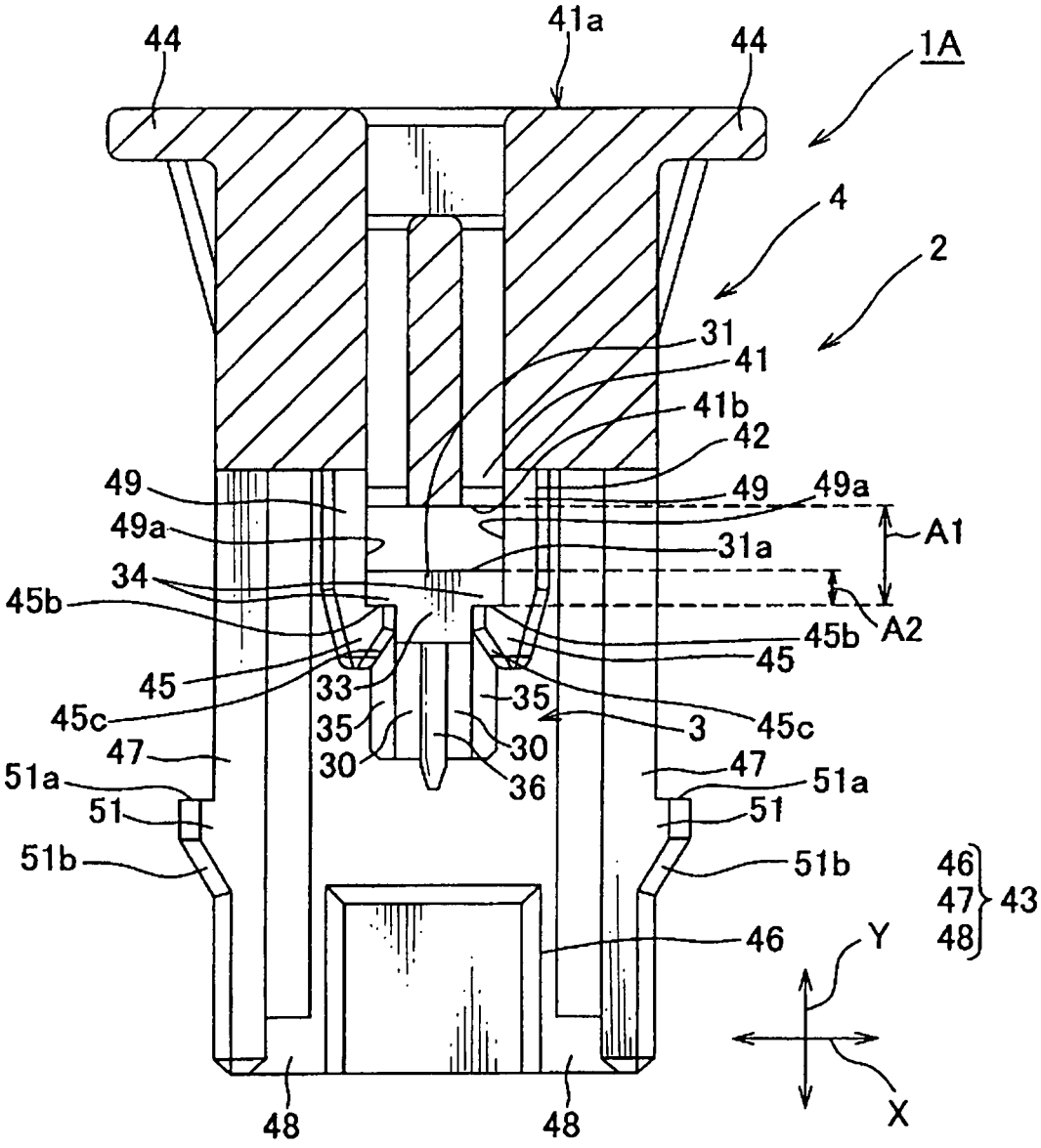
FIG. 16 is a cross-sectional view of a variation of the component-equipped-holder mounting structure of the present invention.

In this embodiment, the dimension A1 is defined such that there exists the gap between the holder body 41 and the housing 31 in the Y-direction, and the dimension B1 is defined such that there exists the gap between the pair of holder arms 49 and the housing 31 in the X-direction, and the dimension C1 is defined such that there exists the gap between the pair of the second locking portions 45 and a portion of the fuse 3 residing between the second locking portions 45 (i.e., housing body 33) in the X-direction. However, the present invention is not limited to this specific configuration. As shown in FIG. 16, out of the dimensions A1, B1, C1, only the dimensions A1 may be defined such that there is the gap between the holder body 41 and the housing 31 in the Y-direction. Also, in FIG. 16, the same reference signs are used to denote the same or like elements, and a detailed description thereof will be omitted.

As shown in FIG. 16, the component-equipped the mounting structure 1A of the holder, for example, the following explains a mechanism for connection and disconnection of the fuse 3 held by the holder 4 in a case where the tuning-fork-type terminal 61 is arranged in a slanted manner with respect to the Y-direction. First, in the provisionally locked state where the fuse 3 held by the holder 4 and the tuning-fork-type terminal 61 of the busbar 6 are not electrically connected to each other (electrically disconnected), the top surface 41*a* of the holder body 41 is pressed in a direction toward the holder mounting portion 7 (the Y-direction), and then the holder 4 is moved in the direction toward the holder mounting portion 7, the tip of the terminal 36 is brought into abutment on the tuning-fork-type terminal 61, fuse 3 is raised within the holder 4, the horizontal surface 41*a* of the holder body 41 and the end 31*a* of the housing 31 are brought into abutment with each other. When the holder 4 is further moved, in a state where the horizontal surface 41*a* of the holder body 41 is in abutment on the end 31*a* of the housing 31, the fuse 3 is moved in the X-direction, and the pair of holder arms 49 elastically deformed such that they are widened by the housing 31, and the fuse 3 is moved (or shifted) in a slanted manner with respect to the Y-direction. In this manner, the tip of the terminal 36 is moved along the outer edge of the tuning-fork-type terminal 61, and is brought into abutment on the entrance portion of the slit 61*a*. At this point, the pair of holder arms 49 remain in the state of elastic deformation in a direction away from each other. When the holder 4 is further moved, the pair of holder arms 49 are gradually moved close to the state before the elastic deformation, and the fuse 3 is moved (or shifted) in the X-direction in the Y-direction. When the holder 4 is further moved, the tip of the terminal 36 is again moved along the inner edge of the slit 61*a* in the X-direction, the pair of holder arms 49 are elastically deformed such that they are widened by the housing 31, and the fuse 3 is moved (or shifted) in the longitudinal direction of the tuning-fork-type terminal in a slanted manner with respect to the Y-direction. Also, the tip of the terminal 36 is pressed into the slit 61*a*. In this manner, the fuse 3 is connected to the tuning-fork-type terminal 61 in a state where the fuse 3 remains in an elastically deformed state in a direction in which the pair of holder arms 49 becomes away from each other (the X-direction).

Also, when the fuse 3 held by the holder 4 and the tuning-fork-type terminal 61 of the busbar 6 are to be electrically disconnected, the fuse 3 is connected to the tuning-fork-type terminal 61 and the pair of holder arms 49 remain in a state of elastic deformation in the direction away from each other. In this state, when the protruding portion 44 is pinched with the protruding portion 44 of the holder body 41 caught by the fingertip and raised in a direction away from the holder mounting portion 7 (the Y-direction), only the holder 4 is raised, and the pair of holder arms 49 is gradually moved toward the state before the elastic deformation. When further raised, the fuse 3 is raised in a state where the locking portions 34, 45 are brought into locking engagement, the terminal 36 is moved (or shifted) in the X-direction and in the Y-direction, the pair of holder arms 49 is restored to the state before the elastic deformation, and simultaneously, the electrical connection between the tuning-fork-type terminal 61 and the fuse 3 is disabled. As has been described in the foregoing, since the dimension is such that at least the gap between the holder body 41 and the housing 31 is created, when the fuse 3 is being inserted into the tuning-fork-type terminal 61, the pair of holder arms 49 is elastically deformed in the direction away from each other (the X-direction), and thereby the fuse 3 is allowed to be moved (or shifted) in the longitudinal direction of the tuning-fork-type terminal 61.

Figure 17:
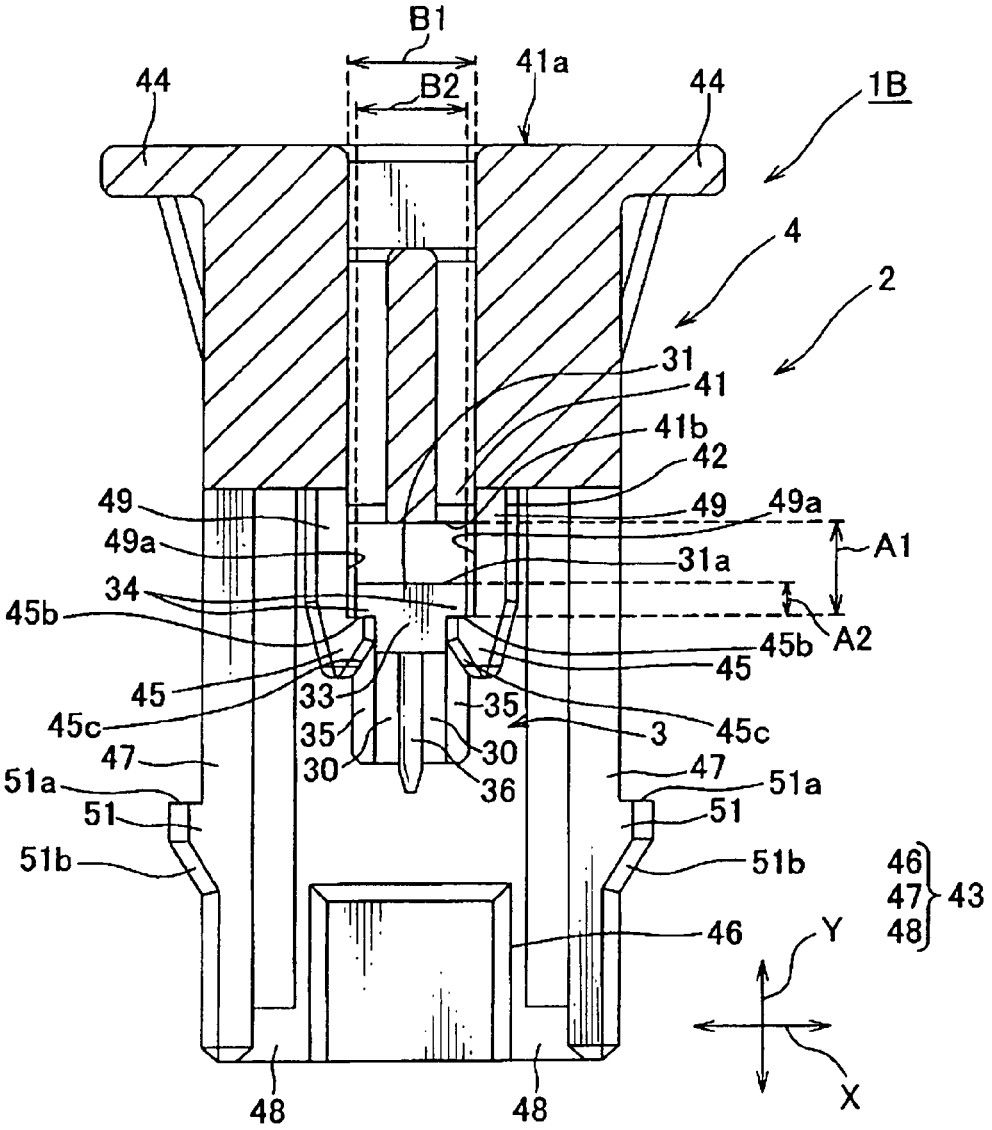
FIG. 17 is a cross-sectional view of another variation of the component-equipped-holder mounting structure of the present invention.
Figure 18:
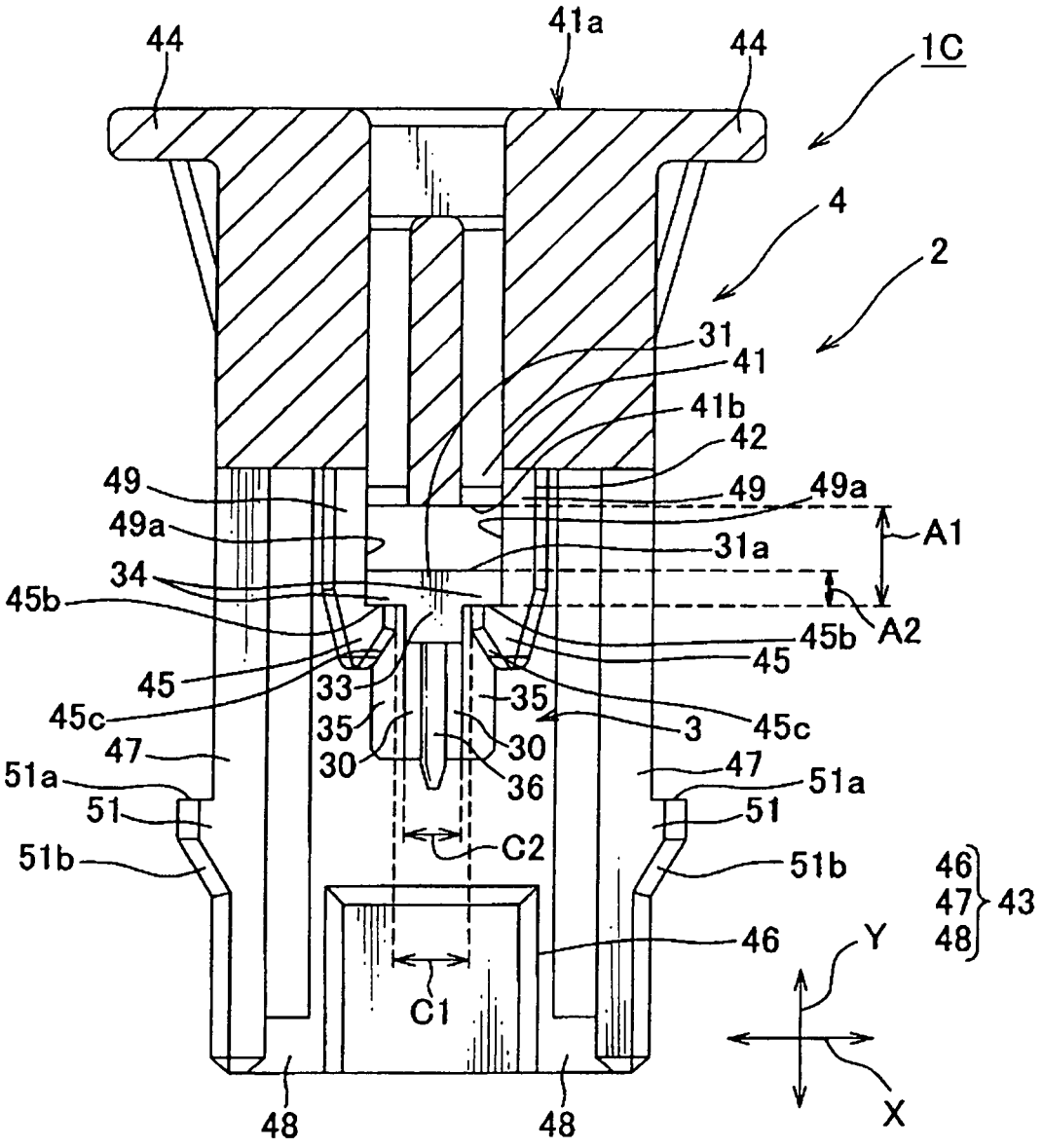
FIG. 18 is a cross-sectional view of yet another variation of the component-equipped-holder mounting structure of the present invention.

Further, in this embodiment, only the dimension A1 out of the dimensions A1, B1, C1 is defined such that the gap is created between the holder body 41 and the housing 31 in the Y-direction. However, the present invention is not limited to this specific configuration. As shown in FIG. 17 illustrating the component-equipped the mounting structure 1B of the holder, the dimension A1 may be defined such that the gap is created between the holder body 41 and the housing 31 in the Y-direction, and the dimension B1 may be defined such that the gap between the pair of holder arms 49 and the housing 31 in the X-direction. Alternatively, as shown in FIG. 18 illustrating the component-equipped the mounting structure 1C of the holder, the dimension A1 may be defined such that the gap is created between the holder body 41 and the housing 31 in the Y-direction, and the dimension C1 may be defined such that a gap is created between the pair of the second locking portions 45 and a portion of the fuse 3 residing between the second locking portions 45 (i.e., the housing body 33) in the X-direction. Also, in FIGS. 17 and 18, the same reference signs are used to denote the same or like elements, and a detailed description thereof will be omitted. According to the above-described component-equipped the mounting structure 1B or 1C of the holder, when the fuse 3 is being inserted into the tuning-fork-type terminal 61, the pair of holder arms 49 is readily elastically deformed in the direction away from each other (the X-direction), and the fuse 3 is allowed to be moved (or shifted) in the longitudinal direction of the tuning-fork-type terminal 61.

Also, in this embodiment, multiple pairs (two pairs in this embodiment) of the holder arms 49 are provided. The present invention is not limited to this specific configuration. The present invention may only include a single pair of the holder arms 49.

Further, in this embodiment, the fuse 3 connected to the dark-current component is used as the electric component. The present invention is not limited to this specific configuration. The electric component may comprise be a fuse, a relay, and a connector that are connected to the tuning-fork-type terminal 61 as the mating terminal (i.e., connected to an electric component other than the dark-current component).

Also, in this embodiment, as the mating terminal, the plurality of tuning-fork-type terminals 61 are used that are provided in one piece with the busbar 6. The present invention is not limited to this specific configuration. The busbar 6 may comprise any female terminal as long as it is connected to the electric wire.

While the invention has been described in terms of specific embodiments, it will be understood by those skilled in the art that various modifications may be made therein without departing from the spirit and scope of the invention. Also, the terms and expressions which have been employed in this specification are used for description and not for limitation, there being no intention in the use of such terms and expressions of excluding equivalents of the features shown and described or portions thereof. Accordingly, the scope of this invention is only defined and limited by the following claims and their equivalents.

What is claimed is:

1. A component-equipped-holder mounting structure comprising:

(a) an electric component having a housing and a terminal extending from the housing;

(b) a holder configured to hold the electric component, the holder including (i) a holder body, (ii) a pair of holder arms extending from the holder body and being configured to position the housing of the electric component therebetween, the holder arms being configured to hold the electric component displaceably such that the electric component is positioned in a longitudinal direction of a mating terminal to be connected to the electric component, and (iii) a locking portion protruding from the pair of holder arms and being configured to be brought into locking engagement with the housing of the electric component; and (c) a holder mounting portion having an accommodating portion configured to accommodate therein a mating terminal with the holder slidably inserted into the holder mounting portion.

2. The component-equipped-holder mounting structure as set forth in claim 1, wherein a dimension of the pair of holder arms from the holder body to the locking portion is defined such that a gap is created between the holder body and the housing; the pair of holder arms are sized and dimensioned to provide a gap between the holder arms and the housing; and the pair of locking portions are sized and dimensioned to provide a gap between the locking portions and a part of the electric component residing between the locking portions.

3. The component-equipped-holder mounting structure as set forth in claim 1, wherein a dimension of the pair of holder arms from the holder body to the locking portion is defined such that a gap is created between the holder body and the housing.

4. The component-equipped-holder mounting structure as set forth in claim 3, wherein the pair of holder arms are sized and dimensioned to provide a gap between the holder arms and the housing.

5. The component-equipped-holder mounting structure as set forth in claim 3, wherein the pair of locking portions are sized and dimensioned to provide a gap between the locking portions and a part of the electric component residing between the locking portions.

* * * * *